US007171733B2

(12) United States Patent
Min

(10) Patent No.: US 7,171,733 B2
(45) Date of Patent: Feb. 6, 2007

(54) CHEST OF CINERARY URNS

(75) Inventor: Taek-Ki Min, Seoul (KR)

(73) Assignee: Arumdaun Dong San Co., Ltd., Seoul (KR)

( * ) Notice: Subject to any disclaimer, the term of this patent is extended or adjusted under 35 U.S.C. 154(b) by 0 days.

(21) Appl. No.: 10/565,258

(22) PCT Filed: Jun. 24, 2004

(86) PCT No.: PCT/KR2004/001528

§ 371 (c)(1),
(2), (4) Date: Jan. 19, 2006

(87) PCT Pub. No.: WO2005/019567

PCT Pub. Date: Mar. 3, 2005

(65) Prior Publication Data

US 2006/0179622 A1 Aug. 17, 2006

(30) Foreign Application Priority Data

Aug. 22, 2003 (KR) ..... 20-2003-0027075

(51) Int. Cl.
*A61G 17/00* (2006.01)

(52) U.S. Cl. ..... 27/35; 27/1; 52/134; 52/136

(58) Field of Classification Search ..... 27/1, 27/35; 52/134, 136, 128
See application file for complete search history.

(56) References Cited

U.S. PATENT DOCUMENTS

| | | | | |
|---|---|---|---|---|
| 3,183,574 | A * | 5/1965 | Diem | 27/1 |
| 3,754,805 | A * | 8/1973 | Pangburn et al. | 312/111 |
| 3,925,944 | A * | 12/1975 | Pickel | 52/134 |
| 3,940,894 | A | 3/1976 | Nunes | |
| 5,287,603 | A * | 2/1994 | Schorman | 27/1 |
| 5,740,637 | A * | 4/1998 | Snow | 52/136 |
| 6,167,600 | B1 * | 1/2001 | Williams et al. | 27/1 |
| 2001/0049867 | A1 * | 12/2001 | Tseng | 27/1 |

FOREIGN PATENT DOCUMENTS

| | | | |
|---|---|---|---|
| JP | 2001169898 | * | 6/2001 |
| KR | 2000-0016629 | | 9/2000 |
| KR | 200256395 | | 11/2001 |
| KR | 2002090968 | * | 12/2002 |
| KR | 20020095531 | | 12/2002 |
| KR | 2003070176 | * | 8/2003 |
| SG | 87211 | * | 3/2002 |
| WO | WO2004112678 | * | 12/2004 |

* cited by examiner

*Primary Examiner*—William L. Miller
(74) *Attorney, Agent, or Firm*—IPLA P.A.; James E. Bame

(57) ABSTRACT

A chest of cinerary urns which has a simple structure capable of allowing convenient placing of cinerary urns therein, while minimizing decay and degradation of cremated remains stored in the placed cinerary urns. The chest of cinerary urns includes a chest body having a plurality of urn receiving spaces, a plurality of cover plates detachably attached to the chest body to cover the urn receiving spaces, seal members each interposed between a portion of the chest body around the associated urn receiving space and the associated cover plate, hollow inlet members each protruded from an associated rear wall portion of the chest body, each of the inlet members communicating with the associated urn receiving space, valve mounting members each coupled to the associated inlet member, and injection valves each fitted in the associated valve mounting member, and centrally provided with an injection hole to allow gas to be injected through the injection hole into the associated inlet member.

12 Claims, 12 Drawing Sheets

[Fig. 1]
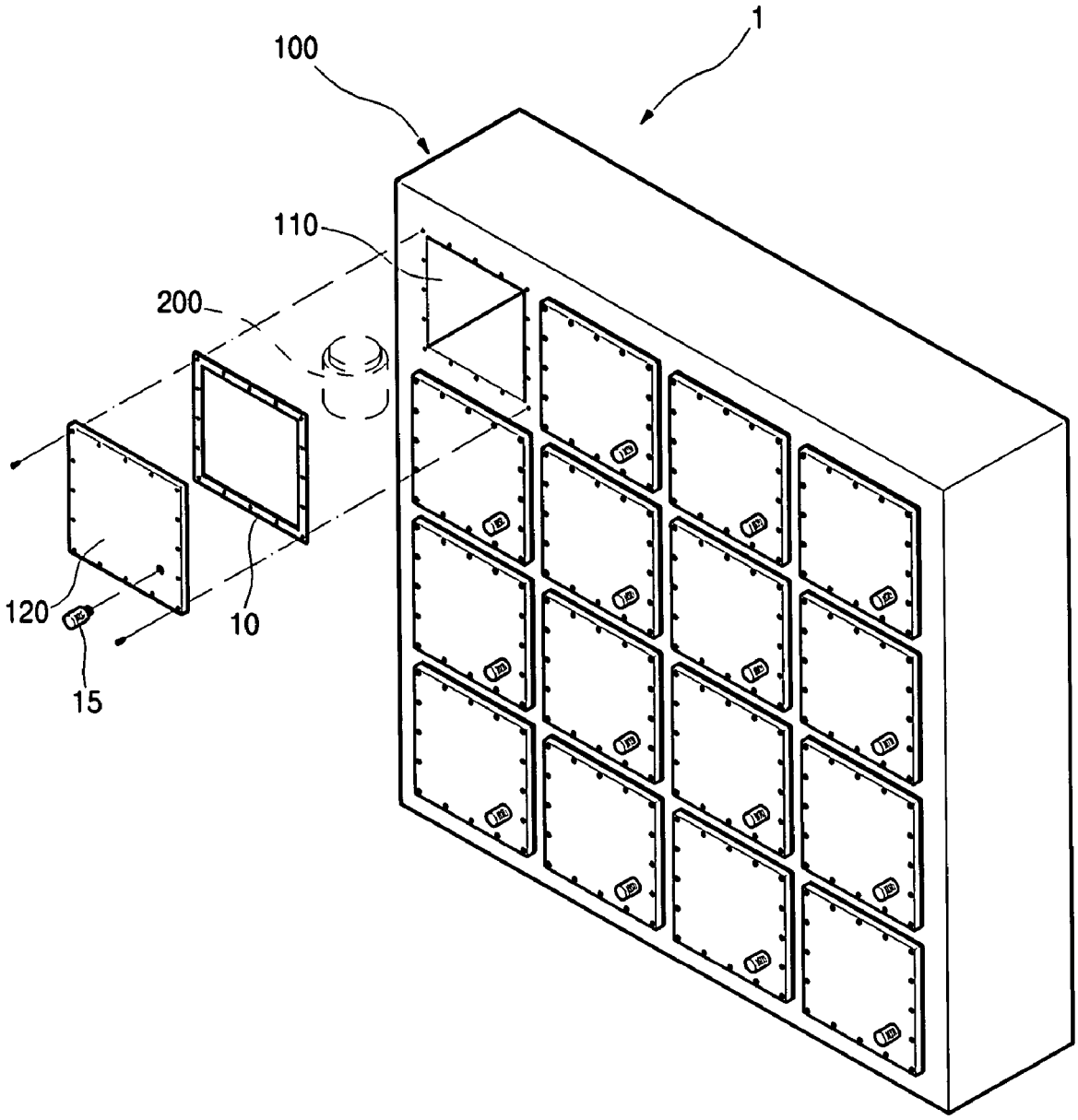

[Fig. 2]
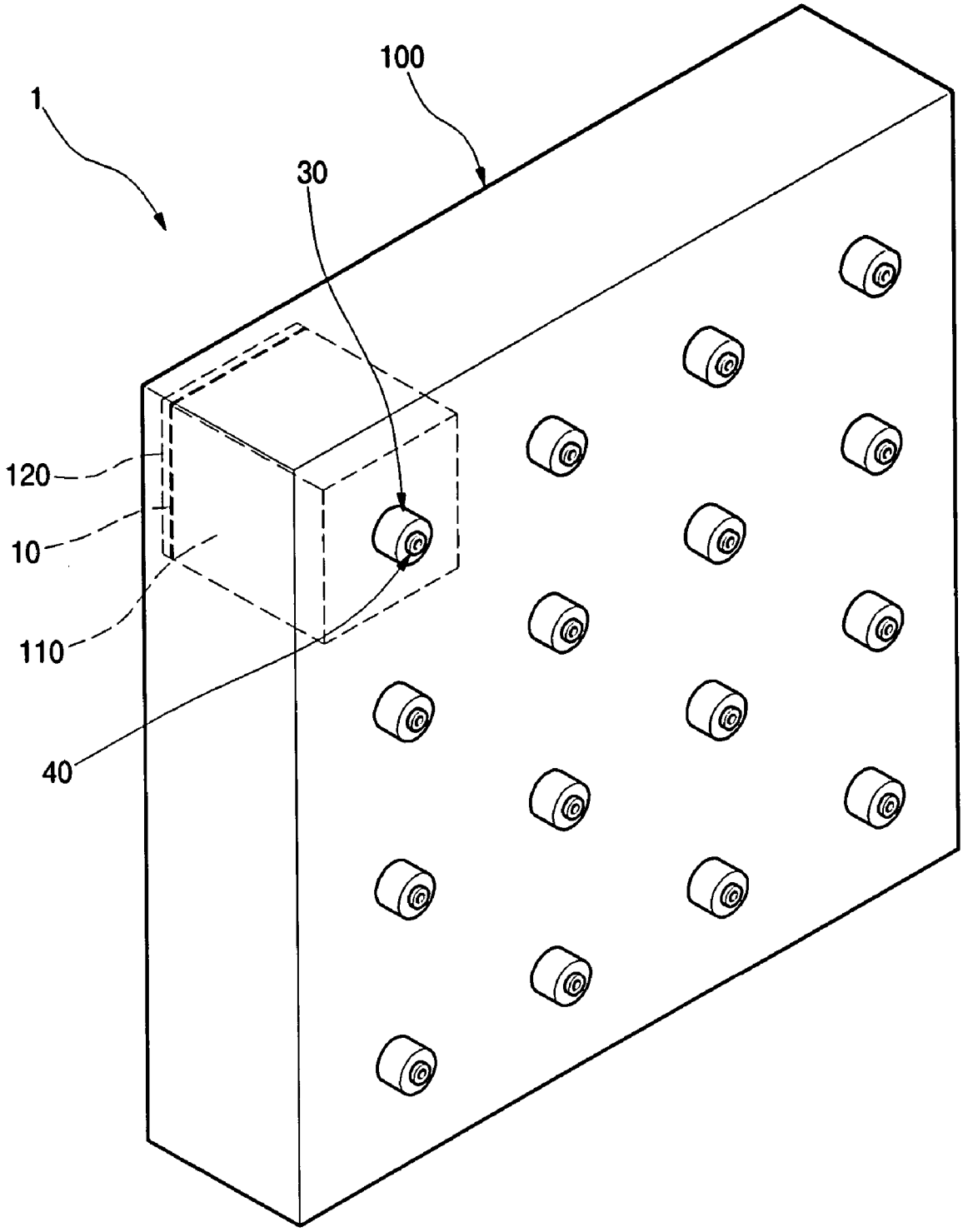

[Fig. 3]
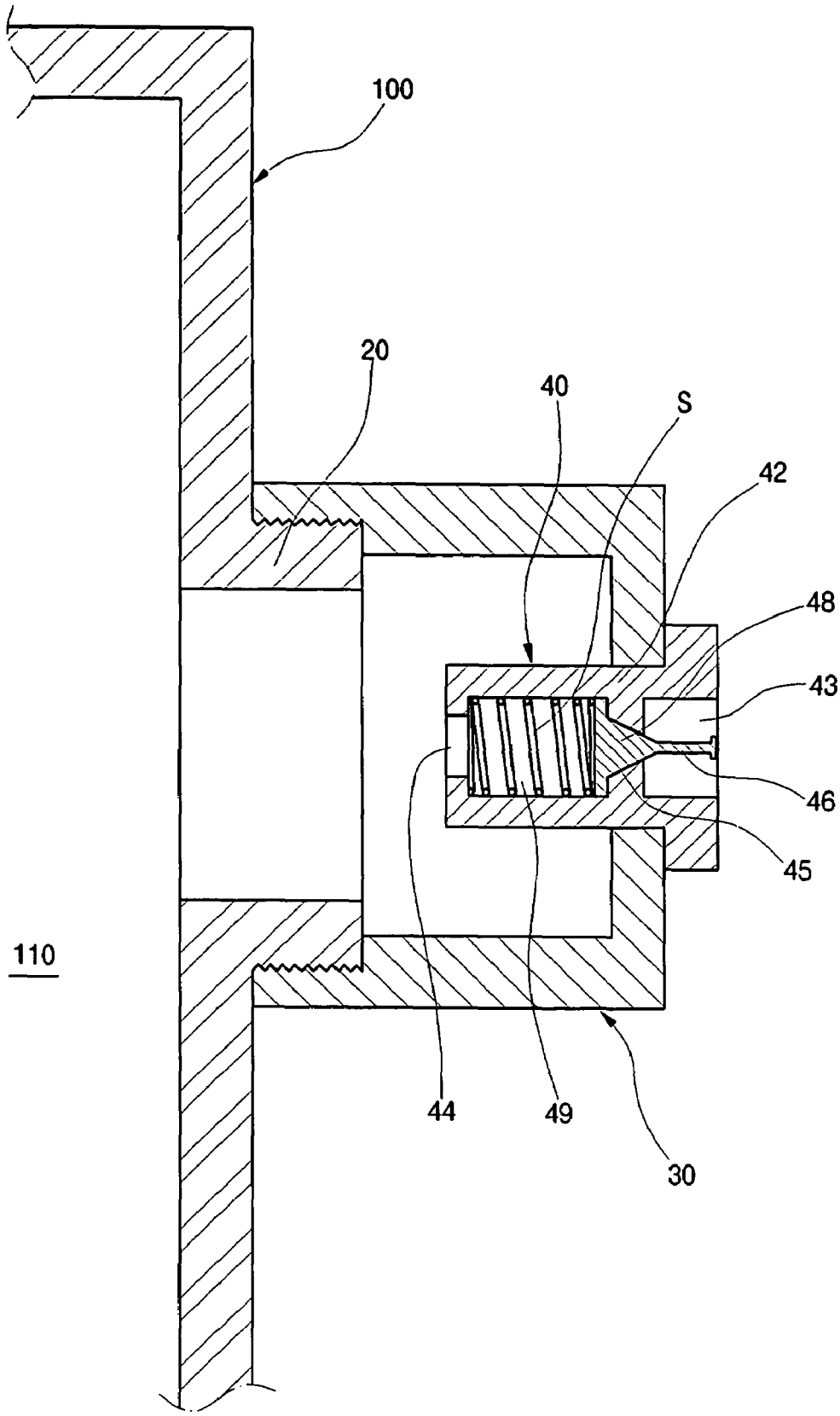

[Fig. 4]
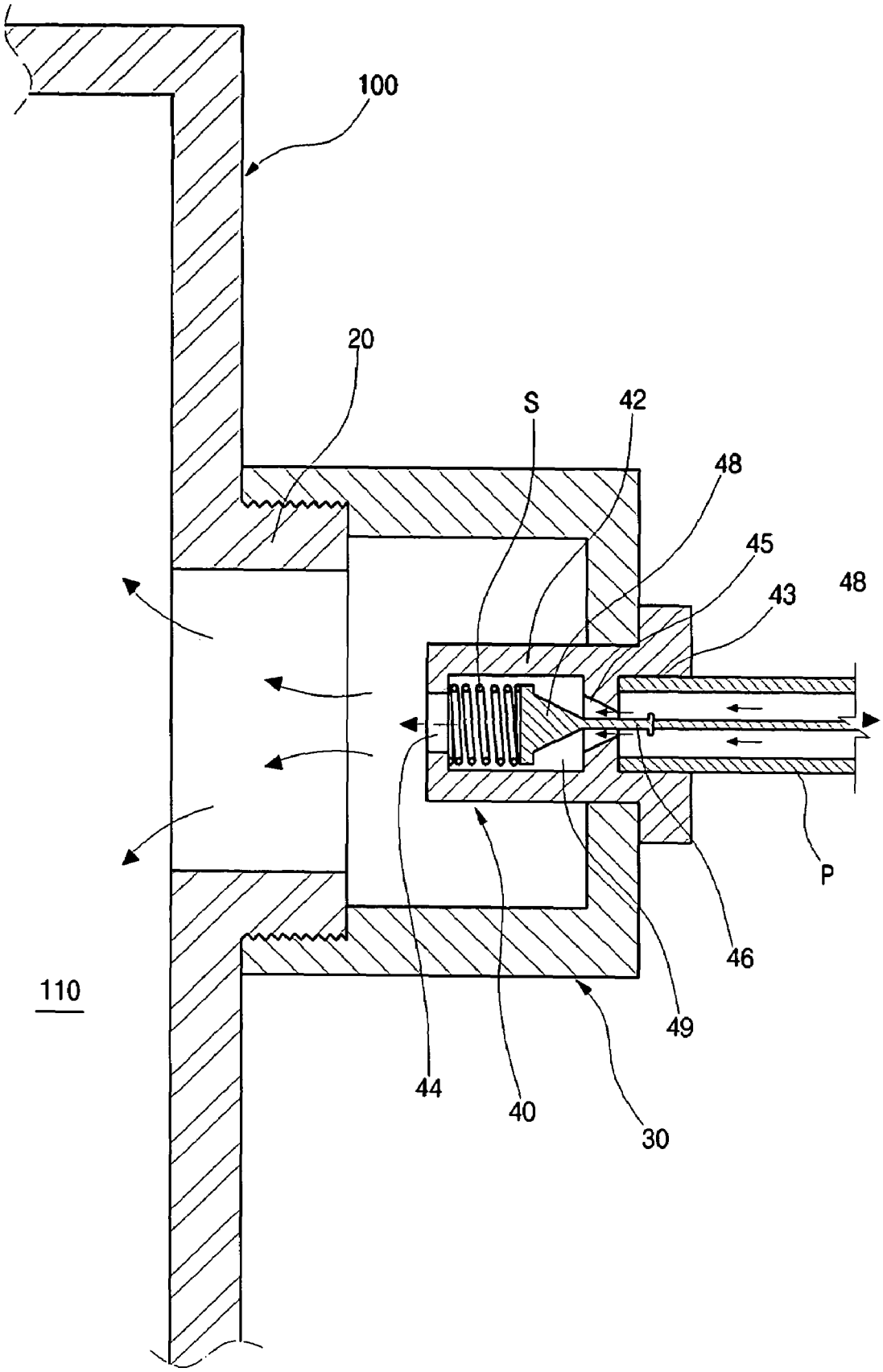

[Fig. 5]
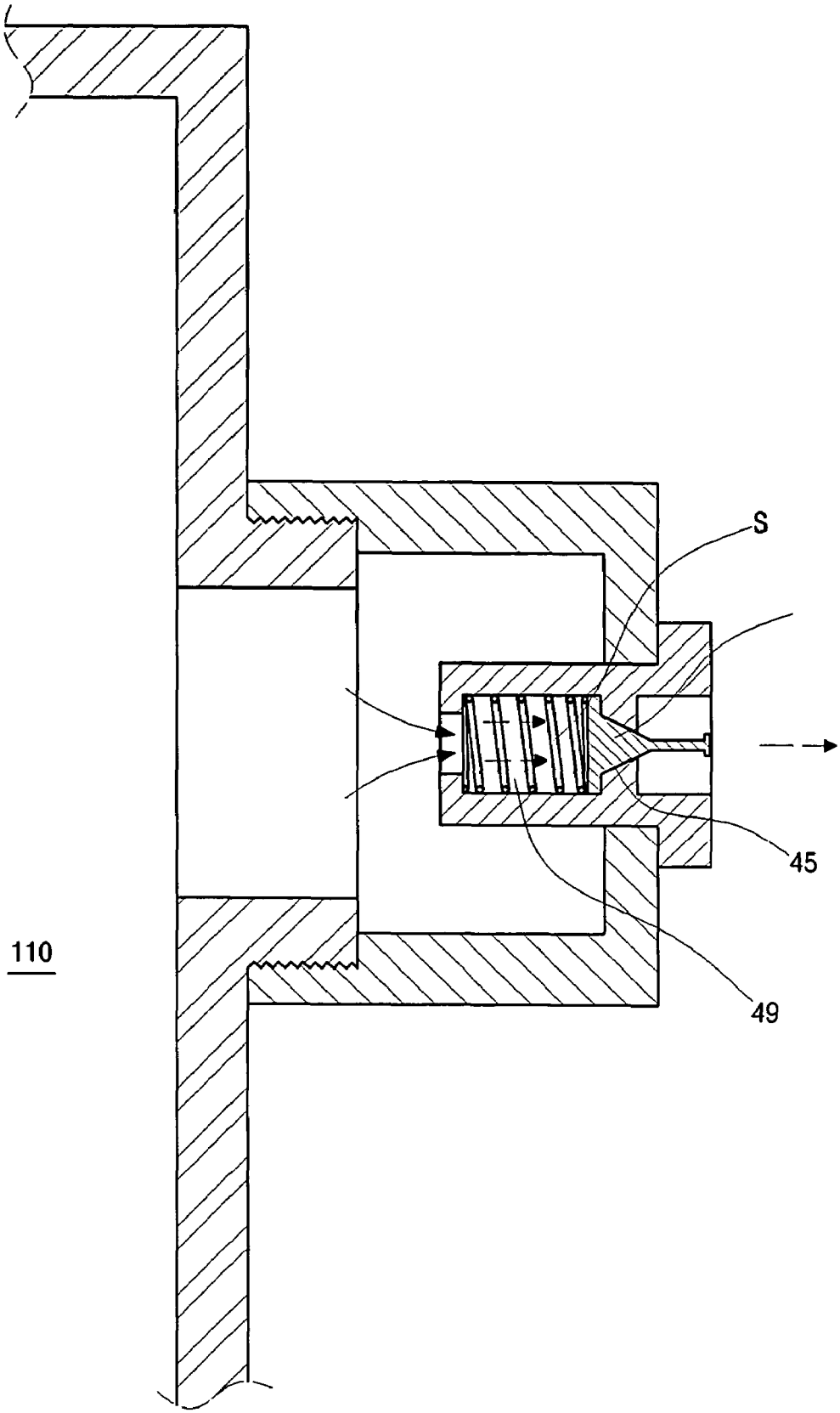

[Fig. 6]
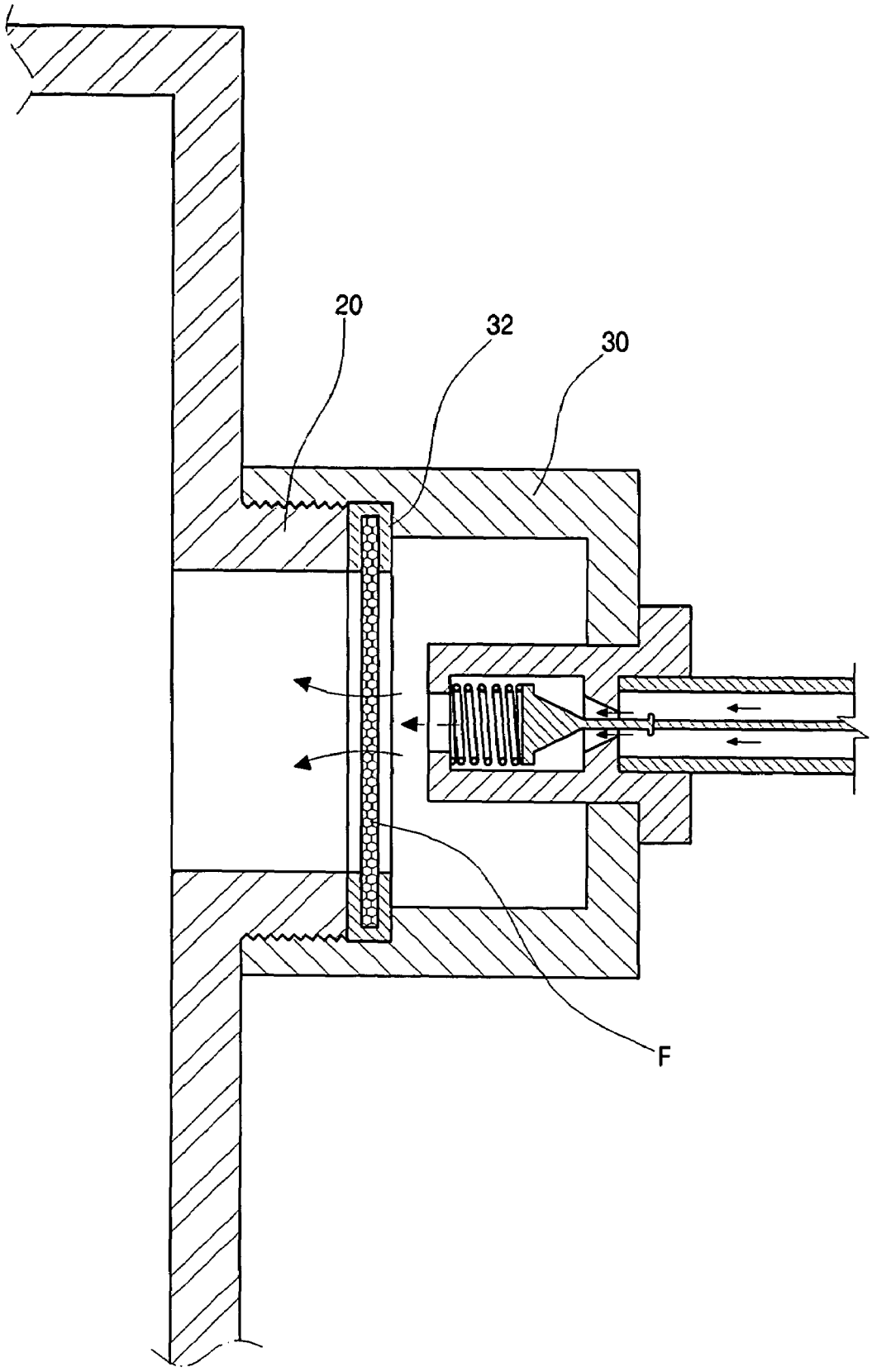

[Fig. 7]
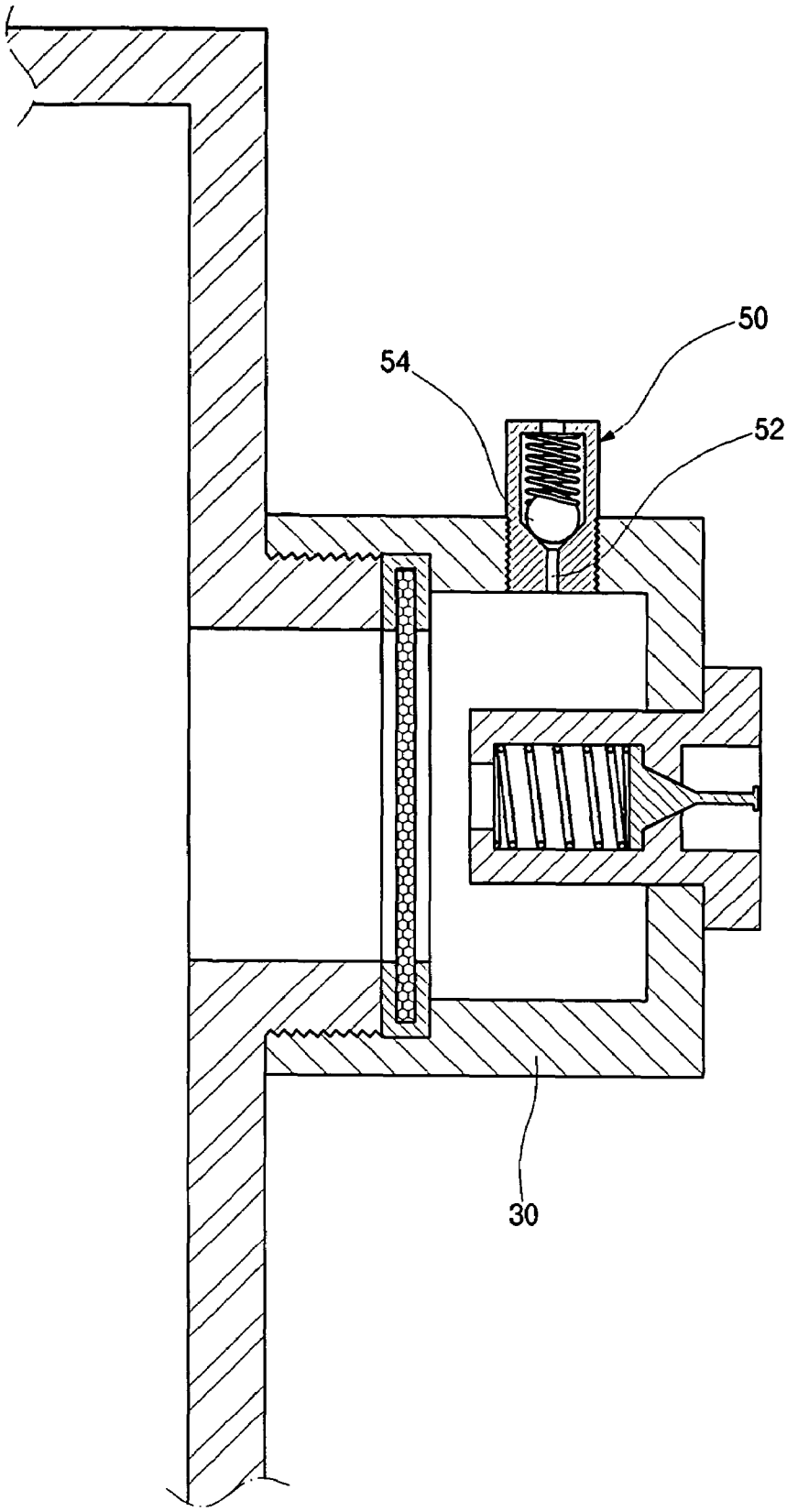

[Fig. 8]
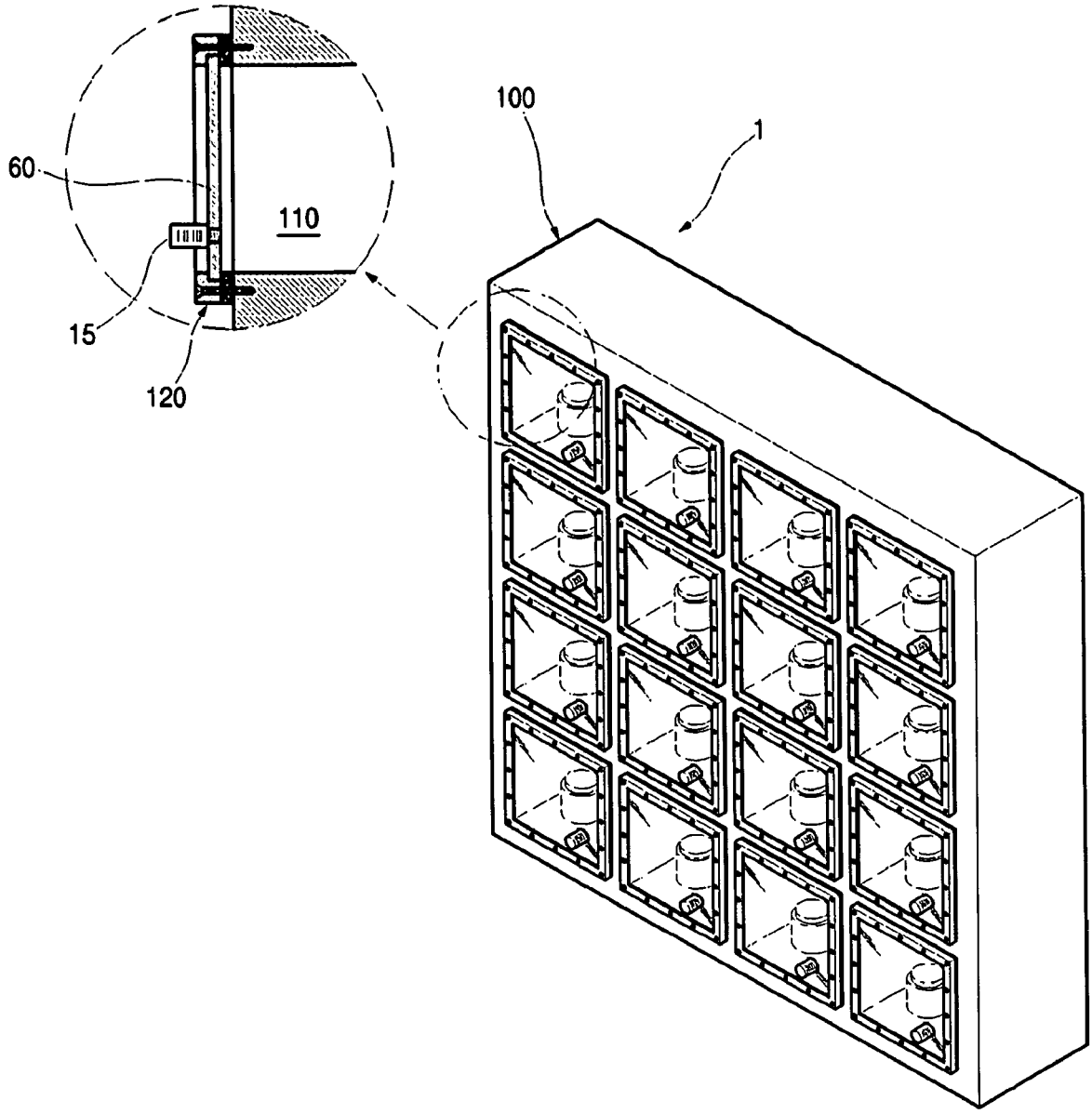

[Fig. 9]
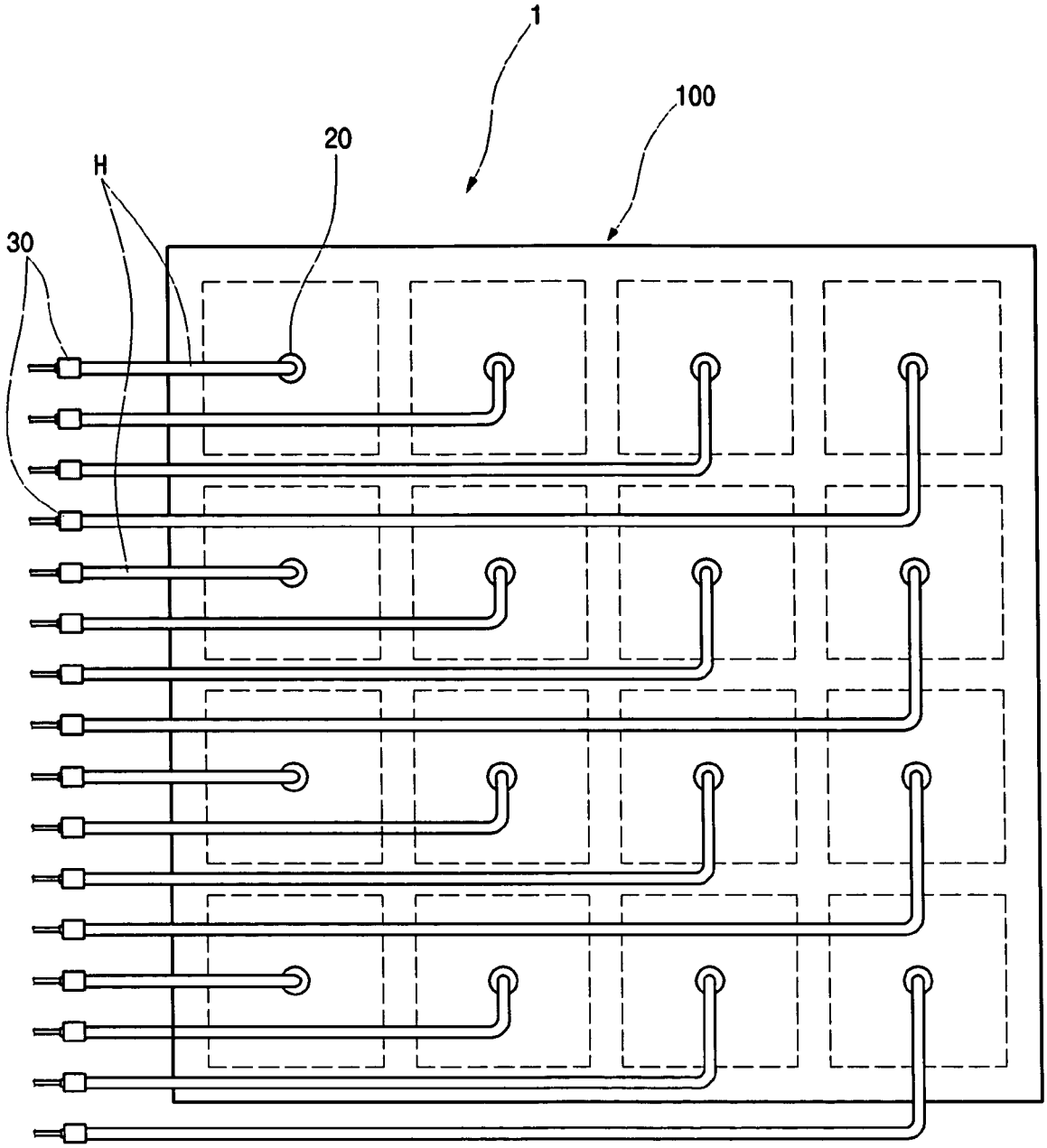

[Fig. 10]
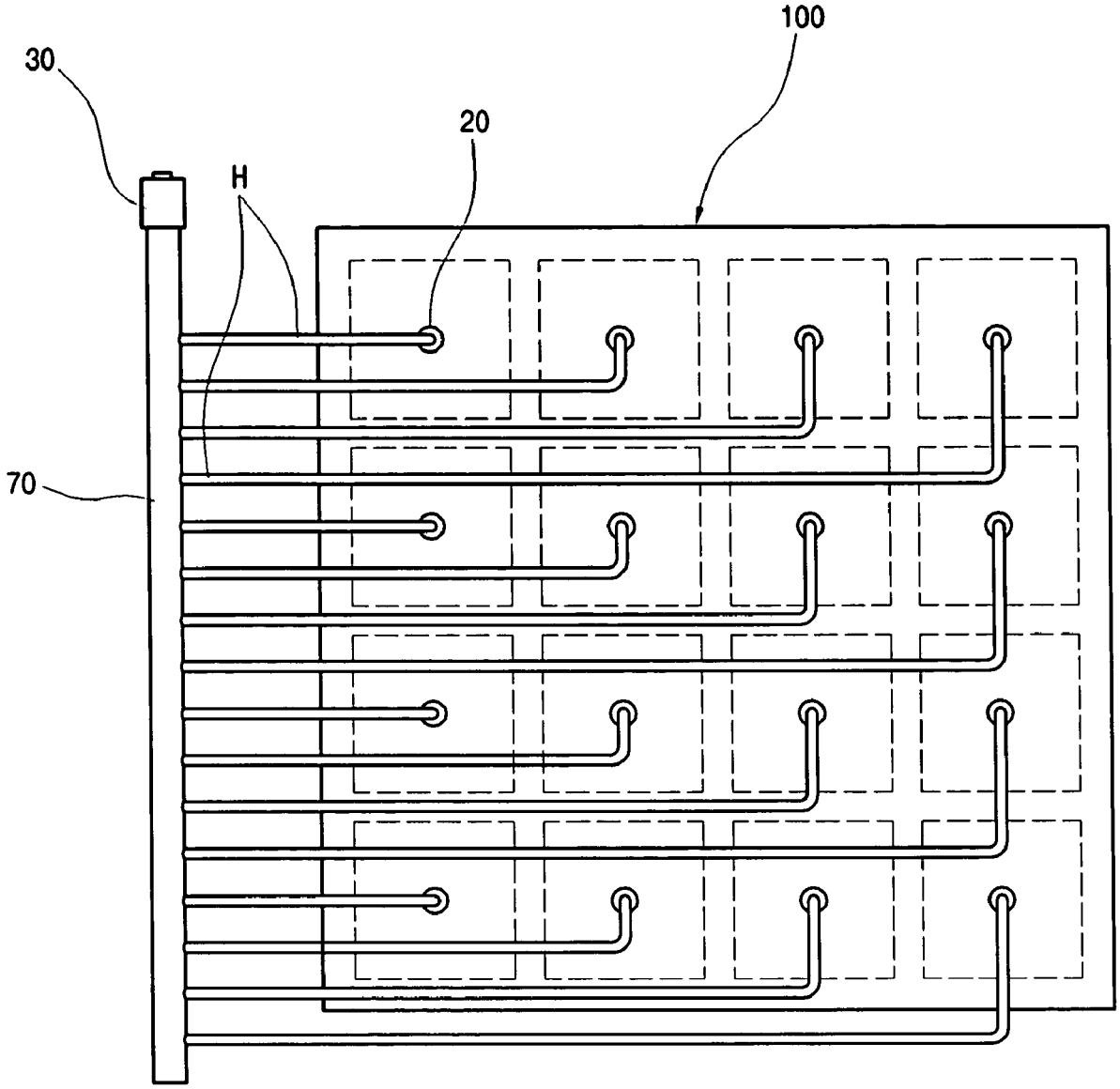

[Fig. 11]
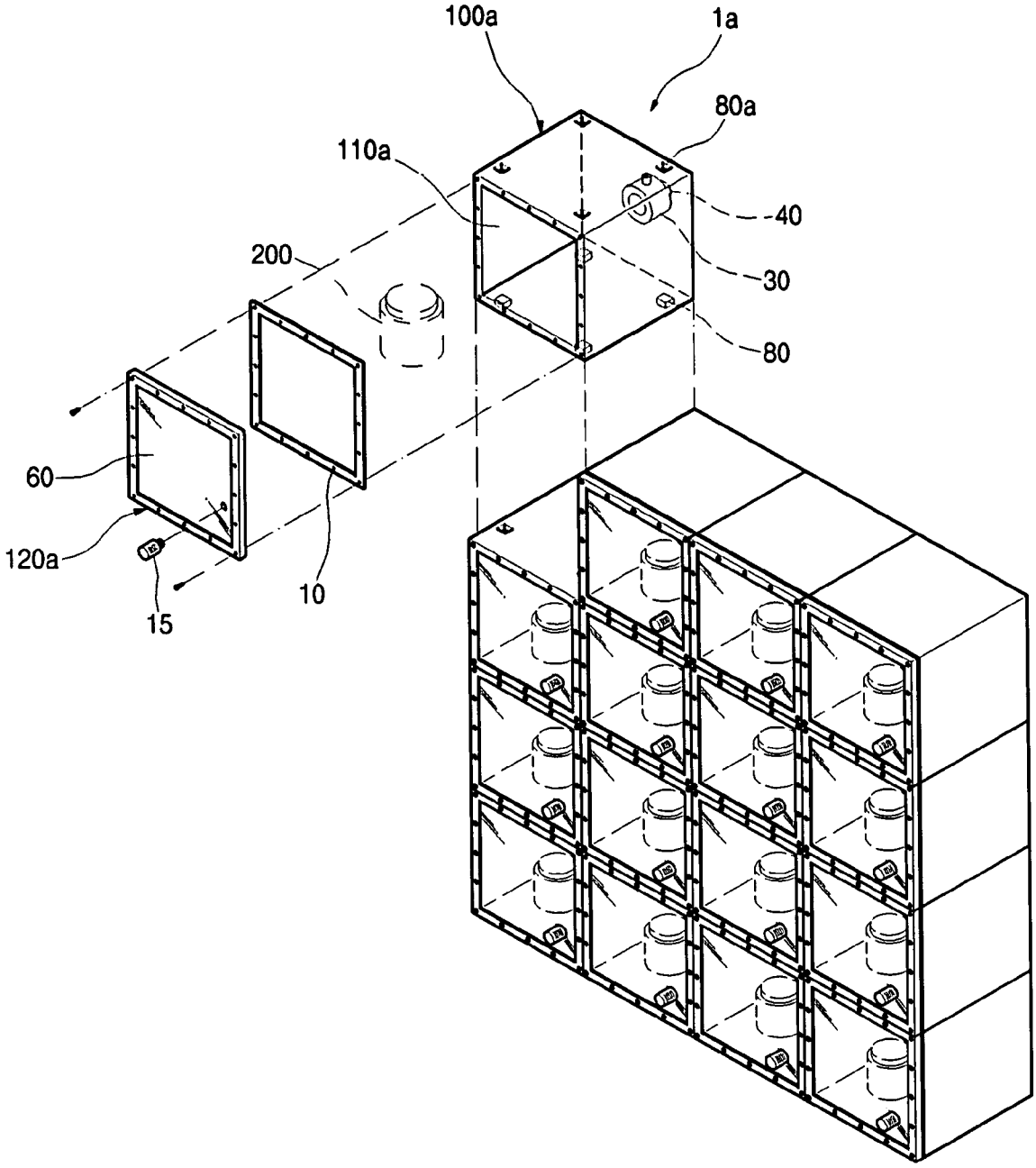

[Fig. 12]
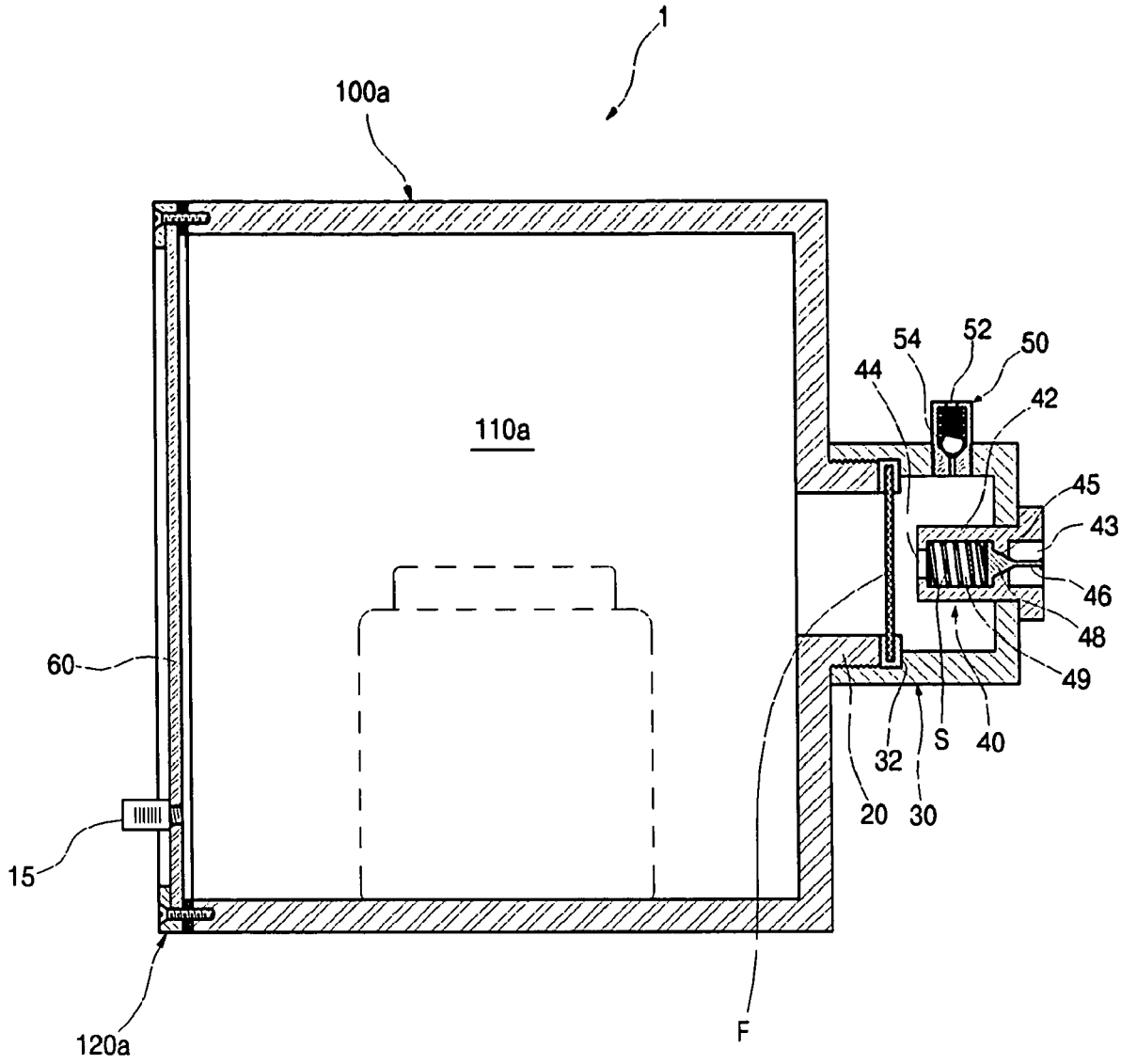

CHEST OF CINERARY URNS

TECHNICAL FIELD

The present invention relates to a chest of cinerary urns in which a plurality of cinerary urns storing cremated remains are placed, and more particularly to a chest of cinerary urns which has a simple stricture capable of allowing convenient placing of cinerary urns therein, while minimizing decay and degradation of cremated remains stored in the placed cinerary urns.

BACKGROUND ART

Cremation of remains of the dead has been increasingly popular. Cremated remains are milled in the form of powder, and then stored in a cinerary urn, which has a box or container stricture. The cinerary urn is placed in a chest of cinerary urns installed outdoors or indoors, along with a mortuary tablet, so as to allow respects to be paid at the cremated remains.

A variety of cinerary urns adapted to store cremated remains have been proposed and conveniently used. Also, a variety of chests of cinerary urns adapted to contain cinerary urns have been proposed and conveniently used.

However, conventional cinerary urns have a problem in that cremated remains stored in the cinerary urns decay and degenerate after a certain period of time elapses, so that they give out a bad smell, thereby causing air pollution and damage to facilities associated with the cinerary urns.

In order to solve this problem, in conventional cases, chests of cinerary urns installed in charnel houses are additionally provided with various devices or facilities to minimize decay and degradation of cremated remains stored in the cinerary urns. In this case, however, there are additional problems of immense economical loss caused by the provision of the additional devices and facilities, and a prolonged period of time required for the installation of the additional devices and facilities.

Meanwhile, it is necessary to maintain the interior of a cinerary urn in a high pressure or high vacuum state, in order to store cremated remains stored in the cinerary urn for a prolonged period of time without decay or degradation of the cremated remains. Recently, proposals have been made, which improve the structure of cinerary urns to maintain the cinerary urns in a high pressure or high vacuum state. However, most of these proposals have problems in that the structure of the cinerary urns is complex, and there is inconvenience in use. Also, there is a difficulty in maintaining the high pressure or high vacuum slate of the cinerary urns.

In order to prevent cremated remains stored in cinerary urns from decaying and degenerating the applicant has proposed a cinerary urn capable of economically and sanitarily storing and maintaining cremated remains, as disclosed in Korean Patent Application No. 2003-41742 entitled 'CINERARY URN FOR CREMATED REMAINS'

DISCLOSURE OF INVENTION

Technical-Solution

The present invention has been made on the basis of Korean Patent Application No. 2003-41742 entitled 'CINERARY URN FOR CREMATED REMAINS' in order to eliminate the above-mentioned problems incurred in the related art, and an object of the invention is to provide a chest of cinerary urns which has a simple structure capable of allowing convenient placement of cinerary urns therein, while minimizing decay and degradation of cremated remains stored in the placed cinerary urns.

Another object of the invention is to provide a chest of cinerary urns capable of preventing foreign matter from entering the chest.

Another object of the invention is to provide a chest of cinerary urns capable of maintaining the interior thereof in an optimal state.

Another object of the invention is to provide a chest of cinerary urns capable of allowing the placed state of cinerary urns in the chest to be easily identified from the outside of the chest.

Another object of the invention is to provide a chest of cinerary urns capable of achieving injection of gas into respective urn receiving spaces at an optional position, in a simultaneous manner or in an individual manner.

Another object of the invention is to provide a chest of cinerary urns capable of allowing respective internal pressures of urn receiving spaces to be easily identified from the outside of the chest.

Another object of the invention is to provide a unit cinerary urn chest capable of providing the same effects as those of the above chests.

Another object of the invention is to provide a unit cinerary urn chest having a structure capable of allowing such unit cinerary urn chests to be easily and conveniently stacked.

In accordance with one aspect, the present invention provides a chest of cinerary urns comprising a chest body having a plurality of urn receiving spaces each being open at a front side thereof to allow a cinerary urn to be placed in the urn receiving space, each of the cinerary urns storing cremated remains, and a plurality of cover plates detachably attached to the chest body at positions corresponding to the urn receiving spaces, respectively, to over respective front sides of the urn receiving spaces, the chest further comprising: seal members each interposed between a portion of the chest body around an associated one of the urn receiving spaces and the cover plate corresponding to the associated urn receiving space; hollow inlet members each protruded from a portion of a rear wall of the chest body corresponding to an associated one of the urn receiving spaces, each of the inlet members communicating with the associated urn receiving space; valve mounting members each coupled to an associated one of the inlet members; and injection valves each fitted in an associated one of the valve mounting members, and centrally provided with an injection hole to allow gas to be injected through the injection hole into the associated inlet member.

Each of the injection valves may comprise: a hollow valve body tightly fitted in the associated valve mounting member, the valve body being provided, at one side thereof, with a tube fitting hole while being provided, at the other side thereof, with a gas inlet communicating with the associated inlet member; a valve seat hole formed at the valve body between the tube fitting hole and the gas inlet, the valve seat hole having a frustoconical cross-section having an area gradually increasing as the valve seat hole extends from the tube fitting hole to the gas inlet; a valve stem arranged in a gas passage defined in the valve body between the gas inlet and the valve seat hole to extend through the valve seat hole while being movable along the gas passage, the valve stem having a cross-section conforming to the cross-section of the valve seat hole; a pressing protrusion extending from one end of the valve stem into the tube fitting hole; and a spring arranged in the gas passage to elastically support the other end of the valve stem.

The chest of cinerary urns may further comprise steps each formed at an inner surface of an associated one of the valve mounting members, and micro filters each arranged in an associated one of the valve mounting members such that the micro filter is interposed between an associated one of the steps and an associated one of the inlet members.

The chest of cinerary urns may further comprise safety valves each mounted to an associated one of the valve mounting members such that the safety valve communicates with the interior of the associated valve mounting member.

Each of the over plate may be opened at a central portion thereof, and provided with a transparent member attached to the central portion.

The chest of cinerary urns may further comprise injection hoses each connected, at one end thereof, to an associated one of the inlet members while being connected, at the other end thereof, to an associated one of the valve mounting members.

The chest of cinerary urns may further comprise injection hoses each connected, at one end thereof, to an associated one of the inlet members, a distribution tube commonly connected to respective other ends of the injection hoses, and a valve mounting member connected to the distribution tube, and provided with the injection valve.

The chest of cinerary urns may further comprise pressure gauges each mounted to an associated one of the cover plates or transparent members.

In accordance with another aspect, the present invention provides a cinerary urn chest comprising a chest body having an urn receiving space being open at a front side thereof to allow a cinerary urn to be placed in the urn receiving space, the cinerary urn storing cremated remains, and a cover plate detachably attached to the chest body at a position corresponding to the urn receiving space to over the front side of the urn receiving space, the chest further comprising: a seal member interposed between a portion of the chest body around the urn receiving space and the over plate; a hollow inlet member protruded from a portion of a rear wall of the chest body while communicating with the urn receiving space; a valve mounting member coupled to the inlet member; and an injection valve fitted in the valve mounting member, and centrally provided with an injection hole to allow gas to be injected through the injection hole into the inlet member.

In the cinerary urn chest, the injection valve may comprise: a hollow valve body tightly fitted in the valve mounting member, the valve body being provided, at one side thereof, with a tube fitting hole while being provided, at the other side thereof, with a gas inlet communicating with the inlet member; a valve seat hole formed at the valve body between the tube fitting hole and the gas inlet, the valve seat hole having a frustoconical cross-section having an area gradually increasing as the valve seat hole extends from the tube fitting hole to the gas inlet; a valve stem arranged in a gas passage defined in the valve body between the gas inlet and the valve seat hole to extend through the valve seat hole while being movable along the gas passage, the valve stem having a cross-section conforming to the cross-section of the valve seat hole; a pressing protrusion extending from one end of the valve stem into the tube fitting hole; and a spring arranged in the gas passage to elastically support the other end of the valve stem.

The cinerary urn chest may further comprise a step formed at an inner surface of the valve mounting member, and a micro filter arranged in the valve mounting member such that the micro filter is interposed between the step and the inlet member.

The cinerary urn chest may further comprise a safety valve mounted to the valve mounting member such that the safety valve communicates with the interior of the valve mounting member.

In the cinerary urn chest, the cover plate may be opened at a central portion thereof, and provided with a transparent member attached to the central portion.

In the cinerary urn chest, the chest body may be provided, at outer surfaces of opposing walls thereof, with a plurality of engagement protrusions and a plurality of engagement grooves corresponding to the engagement protrusions, respectively.

The cinerary urn chest may further comprise a pressure gauge mounted to the cover plate or transparent member.

DESCRIPTION OF DRAWINGS

These and/or other aspects and advantages of the invention will become apparent and more readily appreciated from the following description of the embodiments, taken in conjunction with the accompanying drawings in which:

FIG. 1 is an exploded front perspective view schematically illustrating a chest of cinerary urns according to an embodiment of the present invention;

FIG. 2 is a rear perspective view corresponding to FIG. 1;

FIG. 3 is a sectional view illustrating a valve mounting member included in the chest of cinerary urns shown in FIG. 1;

FIGS. 4 and 5 are sectional views illustrating operation of an injection valve carried out for use of the chest of cinerary urns, in which FIG. 4 illustrates the state in which gas is injected into the chest of cinerary urns, and FIG. 5 illustrates the state in which injection of gas into the chest of cinerary urns is completed;

FIG. 6 is a sectional view illustrating a chest of cinerary urns according to another embodiment of the present invention;

FIG. 7 is a sectional view illustrating a chest of cinerary urns according to another embodiment of the present invention;

FIG. 8 is a sectional view illustrating a chest of cinerary urns Carding to another embodiment of the present invention;

FIG. 9 is a sectional view illustrating a chest of cinerary urns am according to another embodiment of the present invention;

FIG. 10 is a sectional view illustrating a chest of cinerary urns according to another embodiment of the present invention;

FIG. 11 is a perspective view illustrating a unit cinerary urn chest according to another embodiment of the present invention; and FIG. 12 is a sectional view illustrating the unit cinerary urn chest shown in FIG. 11.

BEST MODE

Now, the present invention will be described in more detail with reference to preferred embodiments thereof illustrated in the annexed drawings.

FIG. 1 is an exploded front perspective view schematically illustrating a chest of cinerary urns according to an embodiment of the present invention. FIG. 2 is a rear perspective view corresponding to FIG. 1. FIG. 3 is a sectional view illustrating a valve mounting member included in the chest of cinerary urns shown in FIG. 1.

The chest of cinerary urns according to the embodiment of the present invention, which is designated by reference numeral 1, includes a chest body 100 having a lattice structure to define a plurality of urn receiving spaces 110 arranged in a matrix. Each urn receiving space 110 is open at one side thereof, for example, at the front side thereof, to allow a cinerary urn 200 to be placed in the urn receiving space 110. Each cinerary urn 200 stores cremated remains, which are produced by cremating and milling remains of the dead. A plurality of cover plates 120 are detachably attached to the chest body 100 at positions corresponding to the urn receiving spaces 110, respectively, to over respective front sides of the urn receiving spaces 110.

The chest of cinerary urns according to the embodiment of the present invention has a configuration for injecting gas into the urn receiving spaces of the chest body 100 to maintain the urn receiving spaces in a high pressure or high vacuum state, in order to minimize decay and degradation of cremated remains stored in the cinerary urns placed in the chest, thereby preserving the stored cremated remains for a prolonged period of time while preventing air pollution and damage to surrounding facilities.

That is, a seal member 10 is interposed between a portion of the chest body 100 around each urn receiving space 110 and the cover plate 120 corresponding to the urn receiving space 110. The seal member 10 is made of a soft synthetic resin material such as rubber, silicon, or urethane. Each cover plate 120 is fastened to the chest body 100 by means of screws in a state in which the associated seal member 10 is interposed between the cover plate 120 and the chest body 100.

A hollow cylindrical inlet member 20 is provided at a portion of a rear wall of the chest body 100 corresponding to each urn receiving space 110. The inlet member 20 may be protruded from the associated rear wall portion of the chest body 100 such that the inlet member 20 is integral with the chest body 100. Alternatively, the inlet member 20 may be separate from the chest body 100. In the latter case, the inlet member 20 may be sealably coupled to the chest body 100 in a threaded coupling or forced fitting fashion. Threads are formed at the peripheral surface of the inlet member 20.

A valve mounting member 30 is threadedly coupled to each inlet member 20. An injection valve 40 is fitted in the valve mounting member 30. The injection valve 40 is centrally provided with an injection hole to allow gas to be injected through the injection hole into the associated inlet member 20. Although the valve mounting member 30 is threadedly coupled to the associated inlet member 20 in the illustrated case, they may be coupled in a forced fitting fashion.

The injection valve 40 may include a hollow valve body 42 tightly fitted in the associated valve mounting member 30. The valve body 42 is provided, at one side thereof, with a tube fitting hole 43, in which a gas injection tube extending from a well-known gas charger can be fitted. The valve body 42 is also provided, at the other side thereof, with a gas inlet 44, which communicates with the fitting hole 43 at one side thereof via the interior of the valve body 42 while communicating with the associated inlet member 20 at the other side thereof. A valve seat hole 45 is formed at the valve body 42 between the tube fitting hole 43 and the gas inlet 44. The valve seat hole 45 has a frustoconical cross-section having an area gradually increasing as it extends from the tube fitting hole 43 to the gas inlet 44. A valve stem 48 is arranged in a gas passage 49 defined in the interior of the valve body 42 between the gas inlet 44 and the valve seat hole 45. The valve stem 48 extends through the valve seat hole 45, and is movable along the gas passage 49. The valve stem 48 has a cross-sectional shape conforming to that of the valve seat hole 45. A pressing protrusion 46 extends from one end of the valve stem 48 into the tube fitting hole 43. The pressing protrusion 46 is pressed by the gas injection tube of the gas charger as the gas injection tube is fitted into the tube fitting hole 43, thereby causing the valve stem 48 to move away from the valve seat hole 45. A spring S is arranged in the gas passage 49 to elastically support the other end of the valve stem 48.

In order to easily identify the pressure of gas injected into each urn receiving space 110 from the outside of the urn receiving space 110, a general pressure gauge 15 is mounted to the associated over plate 120 in a threaded coupling or forced fitting fashion. The pressure gauge 15 communicates with the associated urn receiving space 110.

FIGS. 4 and 5 are sectional views illustrating operation of the injection valve carried out for use of the chest of cinerary urns. FIG. 4 illustrates the state in which gas is injected into the chest of cinerary urns. FIG. 5 illustrates the state in which injection of gas into the chest of cinerary urns is completed.

When it is desired to store cremated remains of the dead in the chest of cinerary urns having the above-described configuration, the cinerary urn 200, which stores the cremated remains, is first placed in one urn receiving space 110 of the chest body 100. Thereafter, the cover plate 120 is fastened to the chest body 100 by means of screws in a state in which the seal member 10 is interposed between the cover plate 120 and the chest body 100, as shown in FIG. 2, thereby sealing the urn receiving space 110.

The gas injection tube P of the gas charger is then fitted into the tube fitting hole 43 provided at the valve body 42 of the injection valve 40 fitted in the valve mounting member 30, which is coupled to the inlet member 20 provided at the rear wall portion of the chest body 100 corresponding to the sealed urn receiving space 110. In accordance with the fitting of the gas injection tube P, the pressing protrusion 46 of the valve stem 48 elastically supported by the spring S in the gas passage 49 of the valve body 42 is pressed, thereby causing the valve stem 48 to move away from the valve seat hole 45 against the resilience of the spring S. As a result, the valve seat hole 45 is opened, as shown in FIG. 4. Accordingly, gas injected from the gas injection tube P is introduced into the sealed urn receiving space 110 via the gas passage 49, gas inlet 44 and inlet member 20. Thus, the interior of the urn receiving space 110 is rendered to be in a high pressure or high vacuum state.

When the gas injection tube P is separated from the tube fitting hole 43 under the condition in which the interior of the urn receiving space 110 is in the high pressure or high vacuum state, the valve stem 48 is moved toward the valve seat hole 45 in the gas passage 49 by the resilience of the spring S, thereby closing the valve seat hole 45, as shown in FIG. 5. Thus, the interior of the urn receiving space 110 is maintained in the high pressure or high vacuum state.

In accordance with the above-described embodiment of the present invention, it is possible to maintain the interior of each urn receiving space in a high pressure or high vacuum state, using a simple structure and through a convenient and simple process, and thus, to preserve the cremated remains stored in the cinerary urn placed in the chest of cinerary urns for a prolonged period of time without decay or degradation.

FIG. 6 is a sectional view illustrating a chest of cinerary urns according to another embodiment of the present invention.

The chest of cinerary urns according to this embodiment has a configuration similar to the above-described embodiment, except that it additionally includes a configuration capable of preventing foreign matter contained in gas injected during a gas injection process from being introduced into the urn receiving spaces, thereby injecting only clean gas into the urn receiving spaces.

That is, in accordance with this embodiment, a step 32 is formed at an inner surface of the valve mounting member 30. A general micro filter F adapted to filter foreign matter in the form of fine particles is arranged in the valve mounting member 30 such that it is interposed between the step 32 and the inlet member 20 in a state in which the valve mounting member 30 is coupled to the inlet member 20.

Accordingly, it is possible to inject only clean gas containing no foreign matter into the urn receiving spaces during the gas injection process.

FIG. 7 is a sectional view illustrating a chest of cinerary urns according to another embodiment of the present invention.

The chest of cinerary urns according to this embodiment has a configuration similar to those of the above-described embodiments, except that a safety valve 50 is mounted to the valve mounting member 30 in a general threaded coupling fashion such that it communicates with the interior of the valve mounting member 30, in order to release over-pressure generated due to excessive injection of gas into the associated urn receiving space in the chest of cinerary urns, thereby eliminating a danger to be caused by the over-pressure.

The safety valve 50 may have a well-known structure. In the illustrated case, the safety valve 50 includes a hollow valve body provided with a discharge passage 52 communicating with the interior of the valve mounting member 30, and a ball 54 received in the valve body, and elastically supported by a spring to close the discharge passage 52. When over-pressure is generated due to excessive injection of gas into the urn receiving space, the ball 54 is moved away from the discharge passage 52 against the resilience of the spring by the over-pressure, thereby opening the discharge passage 52. As a result, the over-pressure is released. Thus, it is possible to secure a desired safety against over-pressure generated due to excessive injection of gas into the urn receiving spaces.

FIG. 8 is a sectional view illustrating a chest of cinerary urns according to another embodiment of the present invention.

The chest of cinerary urns according to this embodiment has a configuration similar to those of the above-described embodiments, except that each cover plate 120 is opened at a central portion thereof to allow a transparent member 60 made of glass or transparent acrylic to be attached to the opened portion of the cover plate 120 by means of a general adhesive, in order to identify whether or not the cinerary urn is appropriately preserved in the urn receiving space 110 of the chest body 100 in the chest 1.

Accordingly, it is possible to easily identify the preserved conditions of the cinerary urns placed in the urn receiving spaces of the chest from the outside of the chest.

In this case, the pressure gauge 15, which is adapted to allow the user to easily identify the pressure of gas injected into each urn receiving space from the outside of threaded coupling or forced fitting fashion. The pressure gauge 15 communicates with the associated urn receiving space.

FIG. 9 is a sectional view illustrating a chest of cinerary urns according to another embodiment of the present invention.

The chest of cinerary urns according to this embodiment has a configuration similar to those of the above-described embodiments, except that it additionally includes a configuration capable of coping with the case in which there is insufficient or no working space at the rear side of the chest body 100 in association with the gas injection process. In accordance with this embodiment, an injection hose H is directly connected, at one end thereof, to each inlet member 20 provided at the rear wall of the chest body 100. Each valve mounting member 30 provided with the injection valve is connected to the other end of the associated injection hose H.

Thus, it is possible to easily and conveniently achieve injection of gas into the urn receiving spaces in any positions including the rear side of the chest body in accordance with the present invention.

FIG. 10 is a sectional view illustrating a chest of cinerary urns according to another embodiment of the present invention.

The chest of cinerary urns according to this embodiment has a configuration similar to those of the above-described embodiments, except that the injection hoses H, which are connected to respective inlet members 20 provided at the rear wall of the chest body 100, are commonly connected to a single distribution tube 70, and the distribution tube 70 is provided with one valve mounting member 30 provided with the injection valve, in order to simultaneously inject gas into the urn receiving spaces of the chest, as compared to the case of FIG. 9, in which injection of gas into the urn receiving spaces is carried out in an individual manner.

Thus, the injection of gas into the urn receiving spaces can be achieved not only in an individual manner, but also in simultaneous manner. The latter case is more convenient.

FIG. 11 is a perspective view illustrating a unit cinerary urn chest according to another embodiment of the present invention. FIG. 12 is a sectional view illustrating the unit cinerary urn chest shown in FIG. 11.

Although the chests of cinerary urns according to the above-described embodiments have a structure in which a plurality of urn receiving spaces are provided in one chest body, the unit cinerary urn chest of FIG. 11 has a structure in which a single urn receiving space is provided in one chest body. Similarly to the above-described embodiment, it is possible to prevent decay and degradation of cremated remains stored in the cinerary urns placed in the chest.

In accordance with this embodiment, the unit cinerary urn chest, which is designated by reference numeral 1*a*, includes a chest body 100*a* having an urn receiving space 110*a*. The urn receiving space 110*a* is open at one side thereof, for example, at the front side thereof, to allow a cinerary urn 200 storing cremated remains to be placed in the urn receiving space 100*a*. A cover plate 120*a* is detachably attached to the chest body 100*a* to cover the front side of the urn receiving space 110*a*.

A seal member 10 is interposed between the peripheral edge of the chest body 100*a* around the urn receiving space 110*a* and the cover plate 120*a*. The seal member 10 is made of a soft synthetic resin material such as rubber, silicon, or urethane. The cover plate 120*a* is fastened to the chest body 100*a* by means of screws in a state in which the seal member 10 is interposed between the cover plate 120*a* and the chest body 100*a*.

A hollow cylindrical inlet member 20 is provided at a rear wall of the chest body 100*a*. The inlet member 20 is protruded from the rear wall of the chest body 100*a* such that the inlet member 20 communicates with the urn receiving space 110*a*. Threads are formed at the peripheral surface of the inlet member 20.

A valve mounting member 30 is threadedly coupled to the inlet member 20. An injection valve 40 is fitted in the valve mounting member 30. The injection valve 40 is centrally provided with an injection hole to allow gas to be injected through the injection hole into the inlet member 20. Although the valve mounting member 30 is threadedly coupled to the inlet member 20 in the illustrated case, they may be coupled in a forced fitting fashion.

The injection valve 40 may include a hollow valve body 42 tightly fitted in the valve mounting member 30. The valve body 42 is provided, at one side thereof, with a tube fitting hole 43, in which a gas injection lube extending from a well-known gas charger can be fitted. The valve body 42 is also provided, at the other side thereof, with a gas inlet 44, which communicates with the fitting hole 43 at one side thereof via the interior of the valve body 42 while communicating with the inlet member 20 at the other side thereof. A valve seat hole 45 is formed at the valve body 42 between the tube fitting hole 43 and the gas inlet 44. The valve seat hole 45 has a frustoconical cross-section having an area gradually increasing as it extends from the tube fitting hole 43 to the gas inlet 44. A valve stem 48 is arranged in a gas passage 49 defined in the interior of the valve body 42 between the gas inlet 44 and the valve seat hole 45. The valve stem 48 extends through the valve seat hole 45, and is movable along the gas passage 49. The valve stem 48 has a cross-sectional shape conforming to that of the valve seat hole 45. A pressing protrusion 46 extends from one end of the valve stem 48 into the tube fitting hole 43. The pressing protrusion 46 is pressed by the gas injection tube of the gas charger as the gas injection tube is fitted into the tube fitting hole 43, thereby causing the valve stem 48 to move away from the valve seat hole 45. A spring S is arranged in the gas passage 49 to elastically support the other end of the valve stem 48.

When it is desired to store cremated remains of the dead in the unit cinerary urn chest having the above-described configuration, the cinerary urn 200*a*, which stores the cremated remains, is first placed in the urn receiving space 110*a* of the chest body 100*a*. Thereafter, the cover plate 120 is fastened to the chest body 100*a* by means of screws in a state in which the seal member 10 is interposed between the cover plate 120 and the chest body 100*a*, thereby sealing the urn receiving space 110*a*.

The gas injection tube P (FIG. 4) of the gas charger is then fitted into the tube fitting hole 43 provided at the valve body 42 of the injection valve 40 fitted in the valve mounting member 30, which is coupled to the inlet member 20 provided at the rear wall of the chest body 100*a*. In accordance with the fitting of the gas injection tube P, the pressing protrusion 46 of the valve stem 48 elastically supported by the spring S in the gas passage 49 of the valve body 42 is pressed, thereby causing the valve stem 48 to move away from the valve seat hole 45 against the resilience of the spring S. As a result, the valve seat hole 45 is opened. Accordingly, gas injected from the gas injection tube P is introduced into the sealed urn receiving space 110 via the gas passage 49, gas inlet 44 and inlet member 20. Thus, the interior of the urn receiving space 10 is rendered to be in a high pressure or high vacuum state.

When the gas injection tube P is separated from the tube fitting hole 43 under the condition in which the interior of the urn receiving space 100*a* is in the high pressure or high vacuum state, the valve stem 48 is moved toward the valve seat hole 45 in the gas passage 49 by the resilience of the spring S thereby closing the valve seat hole 45. Thus, the interior of the urn receiving space 110*a* is maintained in the high pressure or high vacuum state.

In accordance with the above-described embodiment of the present invention, it is possible to maintain the interior of the urn receiving space in a high pressure or high vacuum state, using a simple structure and through a convenient and simple process, and thus, to preserve the cremated remains stored in the cinerary urn placed in the unit cinerary urn chest for a prolonged period of time without decay or degradation.

In order to prevent foreign matter contained in gas injected in a gas injection process from being introduced into the urn receiving spaces, a step 32 may be formed at an inner surface of the valve mounting member 30, and a general micro filter F adapted to filter foreign matter may be arranged in the valve mounting member 30 such that it is interposed between the step 32 and the inlet member 20 in a state in which the valve mounting member 30 is coupled to the inlet member 20.

A safety valve 50 may also be mounted to the valve mounting member 30 such that it communicates with the interior of the valve mounting member 30, in order to release over-pressure generated due to excessive injection of gas into the urn receiving space in the unit cinerary urn chest, thereby securing a desired safety against over-pressure. The safety valve 50 may include a hollow valve body provided with a discharge passage 52 communicating with the interior of the valve mounting member 30, and a ball 54 received in the valve body, and elastically supported by a spring to close the discharge passage 52.

In place of the over plate 120, a over plate 120*a* may be used, which is opened at a central portion thereof. In this case, a transparent member 60 made of glass or transparent acrylic may be attached to the opened portion of the cover plate 120*a* by means of a general adhesive, in order to easily identify the preserved condition of the cinerary urn placed in the urn receiving space of the chest from the outside of the chest.

A pressure gauge 15 may be mounted to the cover plate 120 or the transparent member 60 of the cover plate 120*a* in a threaded coupling or forced fitting fashion. In this case, it is possible to easily identify the pressure of gas injected into each urn receiving space from the outside of the urn receiving space.

An injection hose H may be directly connected, at one end thereof, to the inlet member 20 provided at the rear wall of the chest body 100. The valve mounting member 30 provided with the injection valve is connected to the other end of the injection hose H. In this case, it is possible to easily and conveniently achieve injection of gas into the urn receiving space in any positions including the rear side of the chest body.

A plurality of unit cinerary urn chests each having the above-described configuration may be stacked to have a desired stacked structure. Also, the stacked structure of unit cinerary urn chests may be appropriately determined in accordance with the topography of the area where the unit cinerary urn chests are installed. In this case, the injection of gas into the cinerary urns can be achieved not only in an individual manner, but also in simultaneous manner.

In order to more easily achieve the stacking of unit cinerary urn chests, as shown in FIG. 11, the body 100*a* of each unit cinerary urn chest may be provided, at the outer surface of one wall thereof, with a plurality of engagement protrusions 80, while being provided, at the outer surface of the wall opposing the former wall, with a plurality of engagement grooves 80*a* corresponding to the engagement protrusions 80.

INDUSTRIAL APPLICABILITY

As apparent from the above description, in accordance with the present invention, it is possible to provide a chest of cinerary urns which has a simple structure capable of allowing convenient placement of cinerary urns therein, and simply achieving injection of gas into urn receiving spaces to maintain the urn receiving spaces in a high pressure or high vacuum state, thereby minimizing decay and degradation of cremated remains stored in the placed cinerary urns. Accordingly, it is possible to obtain economical advantages, and to prevent air pollution caused by decay or degradation of cremated remains. Also, the stored cremated remains can be preserved for a prolonged period of time without causing damage to surrounding facilities.

Since foreign matter contained in gas to be injected is filtered by the micro filter in the gas injection process, there is an advantage in that only clean gas containing no foreign matter can be injected.

A safety against over-pressure is secured by the safety valve. Accordingly, it is possible to maintain the interior of the cinerary urn chest in an optimal state, that is, under an adequate pressure.

The placed condition of cinerary urns in the chest can be easily identified from the outside of the chest through the transparent members formed at respective cover plates. Accordingly, it is possible to rapidly identify whether or not the cinerary urns have been damaged. The user can also more devoutly pay respects at the cremated remains because he can view the cinerary urn with the naked eye.

It is also possible to easily identify the pressure of gas injected into each urn receiving space by the pressure gauge mounted to the associated cover plate.

The injection of gas into the urn receiving spaces can be carried out at an optional position. In particular, the injection position may be appropriately determined in accordance with the topography of the area where the cinerary urn chest is installed. Also, the injection of gas into the urn receiving spaces may be achieved in an individual manner or in a simultaneous manner. Thus, there is an advantage in that the injection of gas is carried out under more convenient conditions.

In accordance with the present invention, it is also possible to provide a unit cinerary urn having a simple structure, in which a single urn receiving space is provided in one chest body, while being capable of allowing convenient placement of a cinerary urn therein, thereby minimizing decay and degradation of cremated remains stored in the placed cinerary urn. Accordingly, it is possible to obtain economical advantages, and to stack such unit cinerary urns to have various stacked structures. Also, the stacked structure of unit cinerary urn chests may be appropriately determined in accordance with the topography of the area where the unit cinerary urn chests are installed.

Where the engagement protrusions and engagement grooves are provided at respective outer surfaces of opposing walls of each unit cinerary urn chest, the stacking of unit cinerary urn chests can be more easily and conveniently achieved.

Although a few embodiments of the present invention have been shown and described, it would be appreciated by those skilled in the art that changes may be made in this embodiment without departing from the principles and spirit of the invention, the scope of which is defined in the claims and their equivalents.

The invention claimed is:

1. A chest of cinerary urns comprising a chest body having a plurality of urn receiving spaces each being open at a front side thereof to allow a cinerary urn to be placed in the urn receiving space, each of the cinerary urns storing cremated remains, and a plurality of cover plates detachably attached to the chest body at positions corresponding to the urn receiving spaces, respectively, to cover respective front sides of the urn receiving spaces, the chest further comprising:

seal members each interposed between a portion of the chest body around an associated one of the urn receiving spaces and the cover plate corresponding to the associated urn receiving space;

hollow inlet members each protruded from a portion of a rear wall of the chest body corresponding to an associated one of the urn receiving spaces, each of the inlet members communicating with the associated urn receiving space;

valve mounting members each coupled to an associated one of the inlet members; and injection valves each fitted in an associated one of the valve mounting members, and centrally provided with an injection hole to allow gas to be injected through the injection hole into the associated inlet member;

wherein each of the injection valves comprising:

a hollow valve body tightly fitted in the associated valve mounting member, the valve body being provided, at one side thereof, with a tube fitting hole while being provided, at the other side thereof, with a gas inlet communicating with the associated inlet member;

a valve seat hole formed at the valve body between the tube fitting hole and the gas inlet, the valve seat hole having a frustoconical cross-section having an area gradually increasing as the valve seat hole extends from the tube fitting hole to the gas inlet;

a valve stem arranged in a gas passage defined in the valve body between the gas inlet and the valve seat hole to extend through the valve seat hole while being movable along the gas passage, the valve stem having a cross-section conforming to the cross-section of the valve seat hole;

a pressing protrusion extending from one end of the valve stem into the tube fitting hole; and a spring arranged in the gas passage to elastically support the other end of the valve stem.

2. The chest of cinerary urns according to claim 1, further comprising:

steps each formed at an inner surface of an associated one of the valve mounting members; and micro filters each arranged in an associated one of the valve mounting members such that the micro filter is interposed between an associated one of the steps and an associated one of the inlet members.

3. The chest of cinerary urns according to claim 1, further comprising:

safety valves each mounted to an associated one of the valve mounting members such that the safety valve communicates with the interior of the associated valve mounting member.

4. The chest of cinerary urns according to claim 1, wherein:

each of the cover plate is opened at a central portion thereof, and provided with a transparent member attached to the central portion.

5. The chest of cinerary urns according to claim 4, further comprising:

pressure gauges each mounted to an associated one of the cover plates or transparent members.

6. The chest of cinerary urns according to claim 1, further comprising:

injection hoses each connecting to an associated one of the inlet members, to an associated one of the valve mounting members.

7. A cinerary urn chest comprising a chest body having an urn receiving space being open at a front side thereof to allow a cinerary urn to be placed in the urn receiving space, the cinerary urn storing cremated remains, and a cover plate detachably attached to the chest body at a position corresponding to the urn receiving space to cover the front side of the urn receiving space, the chest further comprising:

a seal member interposed between a portion of the chest body around the urn receiving space and the cover plate;

a hollow inlet member protruded from a portion of a rear wall of the chest body while communicating with the urn receiving space;

a valve mounting member coupled to the inlet member; and an injection valve fitted in the valve mounting member, and centrally provided with an injection hole to allow gas to be injected through the injection hole into the inlet member;

wherein the injection valve comprising:

a hollow valve body tightly fitted in the valve mounting member, the valve body being provided, at one side thereof, with a tube fitting hole while being provided, at the other side thereof, with a gas inlet communicating with the inlet member;

a valve seat hole formed at the valve body between the tube fitting hole and the gas inlet, the valve seat hole having a frustoconical cross-section having an area gradually increasing as the valve seat hole extends from the tube fitting hole to the gas inlet;

a valve stem arranged in a gas passage defined in the valve body between the gas inlet and the valve seat hole to extend through the valve seat hole while being movable along the gas passage, the valve stem having a cross-section conforming to the cross-section of the valve seat hole;

a pressing protrusion extending from one end of the valve stem into the tube fitting hole; and a spring arranged in the gas passage to elastically support the other end of the valve stem.

8. The cinerary urn chest according to claim 7, further comprising:

a step formed at an inner surface of the valve mounting member; and a micro filter arranged in the valve mounting member such that the micro filter is interposed between the step and the inlet member.

9. The cinerary urn chest according to claim 7, further comprising:

a safety valve mounted to the valve mounting member such that the safety valve communicates with the interior of the valve mounting member.

10. The cinerary urn chest according to claim 7, wherein: the cover plate is opened at a central portion thereof, and provided with a transparent member attached to the central portion.

11. The cinerary urn chest according to claim 10, further comprising: a pressure gauge mounted to the cover plate or transparent member.

12. The cinerary urn chest according to claim 7, wherein the chest body is provided, at outer surfaces of opposing walls thereof, with a plurality of engagement protrusions and a plurality of engagement grooves corresponding to the engagement protrusions, respectively.

* * * * *